US011045370B1

(12) United States Patent
Tu

(10) Patent No.: US 11,045,370 B1
(45) Date of Patent: Jun. 29, 2021

(54) ELEVATION-TYPE ARMREST

(71) Applicant: KING PAO AN CO., LTD., Taichung (TW)

(72) Inventor: Yu-Ming Tu, Tainan (TW)

(73) Assignee: KING PAO AN CO., LTD., Taichung (TW)

( * ) Notice: Subject to any disclaimer, the term of this patent is extended or adjusted under 35 U.S.C. 154(b) by 0 days.

(21) Appl. No.: 16/858,741

(22) Filed: Apr. 27, 2020

(51) Int. Cl.

| | |
|---|---|
| ***A47C 1/03*** | (2006.01) |
| ***A47C 7/54*** | (2006.01) |
| ***A61G 5/12*** | (2006.01) |
| ***A61G 5/10*** | (2006.01) |

(52) U.S. Cl.
CPC ..... *A61G 5/125* (2016.11); *A61G 5/1056* (2013.01); *A47C 1/03* (2013.01); *A47C 1/0303* (2018.08); *A47C 7/54* (2013.01); *A47C 7/541* (2018.08)

(58) Field of Classification Search
CPC ..... A47C 1/03; A47C 1/0303; A47C 7/54; A47C 7/541; A61G 5/125; A61G 5/1056
USPC ..... 297/83, 84, 85 L, 411.36
See application file for complete search history.

(56) References Cited

U.S. PATENT DOCUMENTS 5,997,092 A * 12/1999 Slaven ..... B60N 2/0232 297/411.36

* cited by examiner

*Primary Examiner* — Rodney B White
(74) *Attorney, Agent, or Firm* — Bruce Stone LLP; Joseph A. Bruce

(57) ABSTRACT

An elevation-type armrest includes a driving assembly and a cushioning assembly. The driving assembly includes a worm, a crank, an axle, a shaft, a worm gear, two toothed wheels and two pinions. The crank is connected to the worm. The axle extends perpendicular to the worm. The worm gear is connected to the axle and engaged with the worm. The first toothed wheel is connected to the axle. The shaft extends parallel to the axle. The second toothed wheel is connected to the shaft and engaged with the first toothed wheel. The pinions are connected to two ends of the shaft. The cushioning assembly includes a supporting tube connected to two racks. Each of the racks includes a toothed portion movably located in a corresponding one of the cylinders and engaged with a corresponding one of the pinions.

8 Claims, 6 Drawing Sheets

ELEVATION-TYPE ARMREST

BACKGROUND OF INVENTION

1. Field of Invention

The present invention relates to a nursing chair and, more particularly, to an armrest-lift apparatus for adjusting the elevation of an armrest to according to a patient's need.

2. Related Prior Art

A nursing chair is used to support a senior citizen or a patient when he or she gets off a hospital bed. A nursing chair is often a recliner that allows a user to sit or lie in it, and includes two armrests to support and protect the user's arms. However, the armrests are in a fixed elevation and could not satisfy the user all the time. For example, the user might prefer a different elevation of the armrests while he or she is resting from while he or she is eating. Moreover, the user needs help to sit down in the nursing chair or stand up from the nursing chair. The armrests sometimes cause troubles for the user while he or she is sitting down in the nursing chair or standing up from the nursing chair.

The present invention is therefore intended to obviate or at least alleviate the problems encountered in prior art.

SUMMARY OF INVENTION

It is the primary objective of the present invention to provide a recliner with an elevation-type armrest.

To achieve the foregoing objective, the elevation-type armrest includes a driving assembly and a cushioning assembly. The driving assembly includes a trough, a box, two cylinders, a worm, a crank, an axle, a worm gear, a first toothed wheel, a shaft, a second toothed wheel and two pinions. The trough is connected to a side of a recliner. The box is formed in a middle section of the trough. Then cylinders are connected to two opposite ends of the trough. Each of the cylinders includes an aperture. The worm includes a first section located in the box and a second section located out of the box. The crank is connected to the second section of the worm. The axle is located in the box so that the axle extends perpendicular to the worm. The worm gear is connected to the axle and engaged with the worm. The first toothed wheel is connected to the axle. The shaft is located in the trough so that the shaft extends parallel to the axle. The second toothed wheel is connected to the shaft and engaged with the first toothed wheel. The pinions are connected to two ends of the shaft. Each of the pinions comprises a portion located in a corresponding one of the cylinders via the aperture. The cushioning assembly includes a supporting tube connected to two racks. Each of the racks includes a toothed portion movably located in a corresponding one of the cylinders and engaged with a corresponding one of the pinions.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
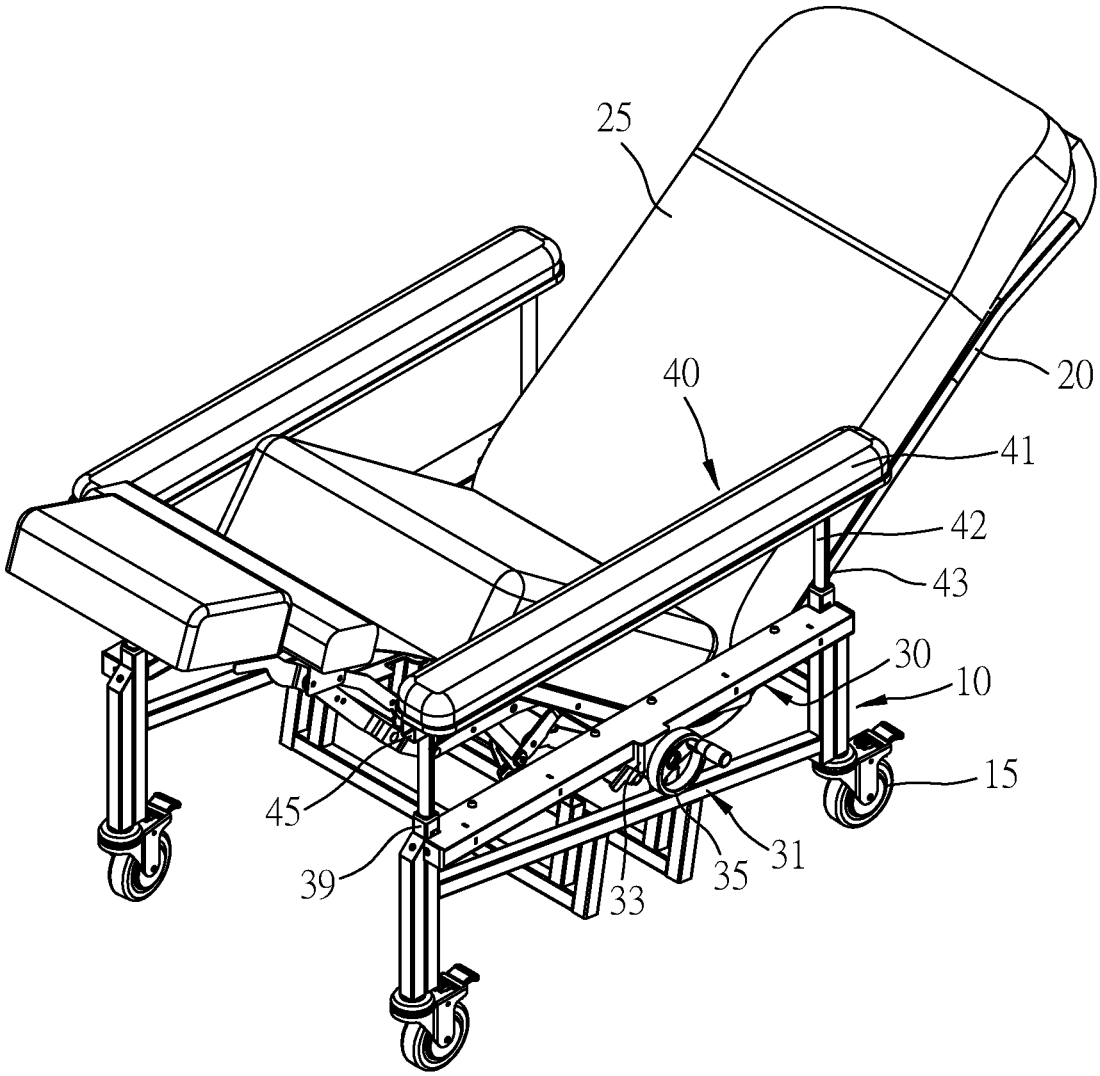
FIG. 1 is a perspective view of a nursing chair equipped with two elevation-type armrests according to the preferred embodiment of the present invention.

Referring to FIG. 1, a recliner 10 includes four wheels 15, a reclining mechanism 20, multi-sectional cushion 25 and two elevation-type armrests 30 according to the preferred embodiment of the present invention. recliner 10. The wheels 15 is connected to a lower portion of the reclining mechanism 20. The multi-sectional cushion 25 is supported on an upper portion of the reclining mechanism 20. The reclining mechanism 20 is operable to move the recliner 10 to various positions so that a user can sit or lie in the recliner 10. Each of the elevation-type armrests 30 is connected to a corresponding one of two opposite sides of the reclining mechanism 20.

Figure 2:
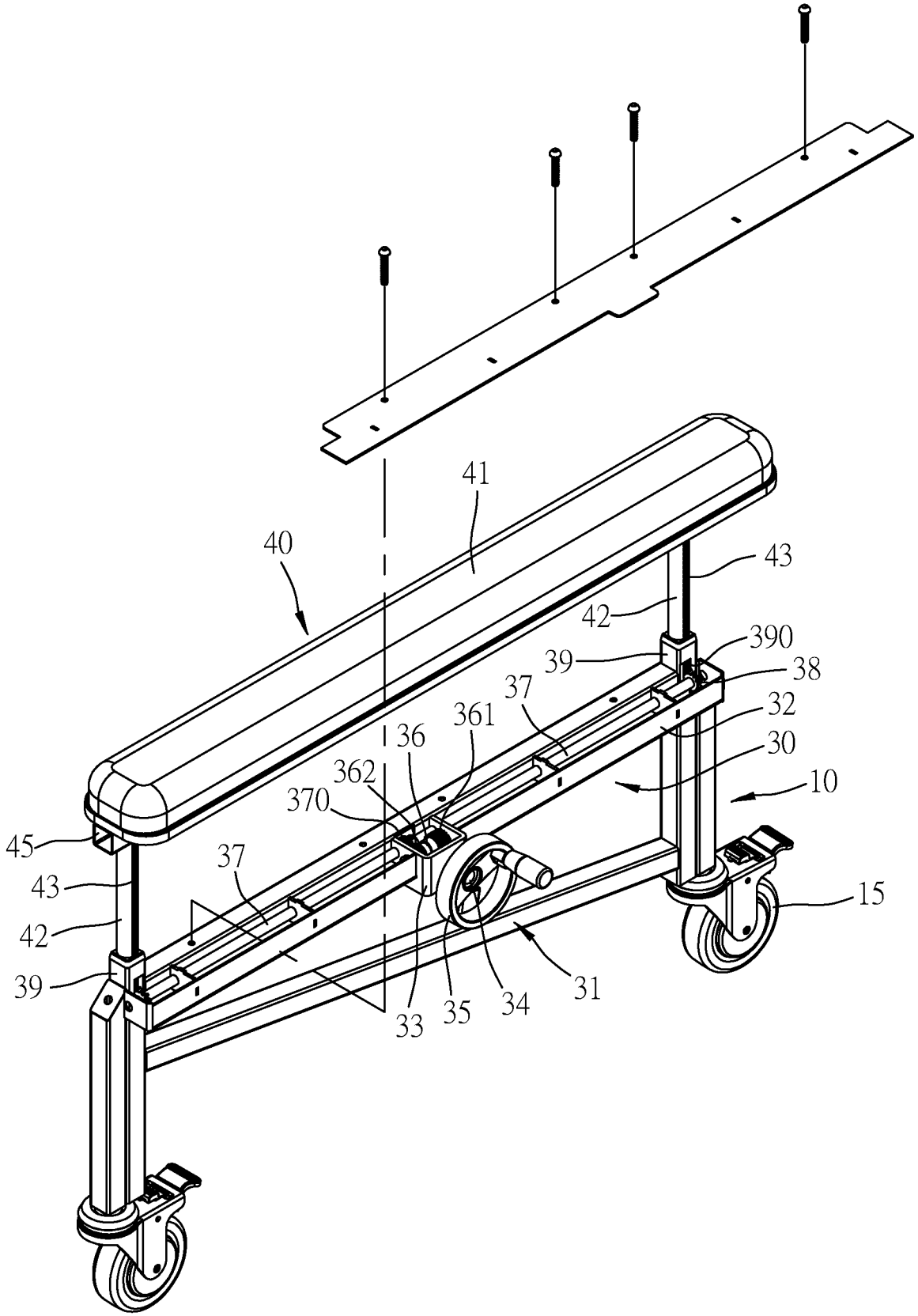
FIG. 2 is an exploded view of one of the armrest-supporting apparatuses shown in FIG. 1.
Figure 3:
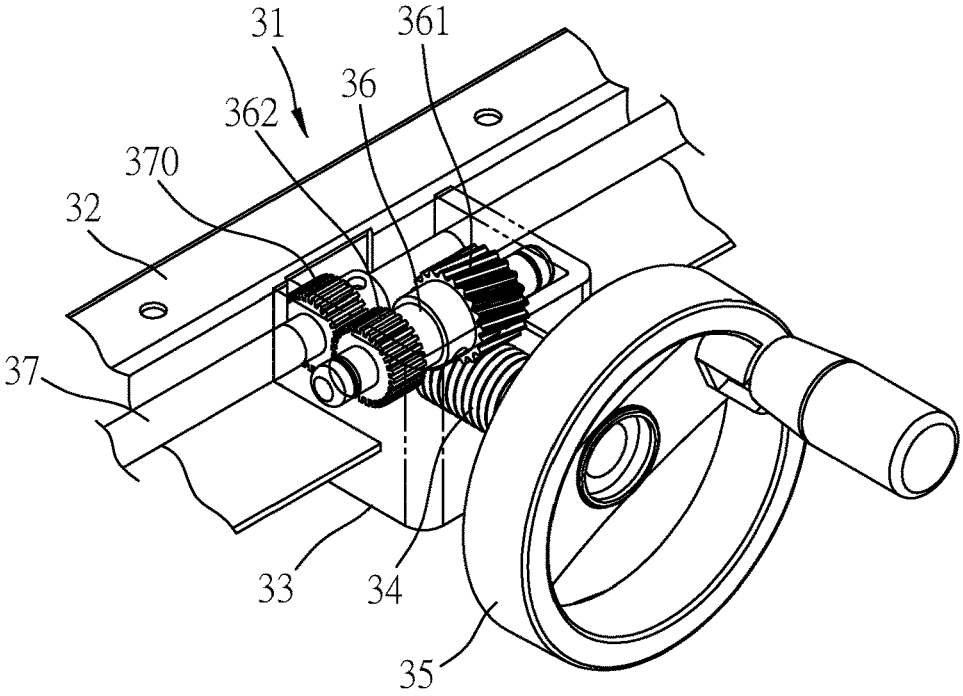
FIG. 3 is an enlarged partial view of the armrest-supporting apparatus shown in FIG. 2.
Figure 4:
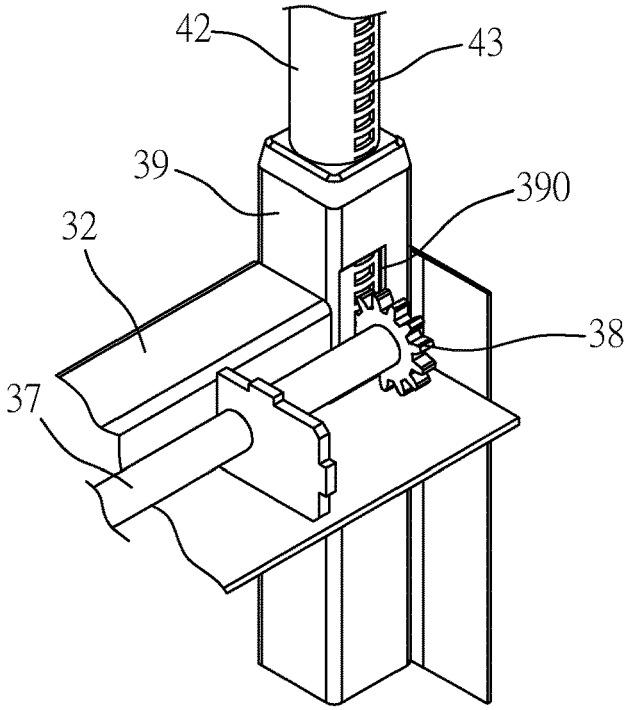
FIG. 4 is an enlarged partial view of the armrest-supporting apparatus shown in FIG. 2.

Referring to FIGS. 2 through 4, an exemplary one of the elevation-type armrests 30 is shown. The elevation-type armrest 30 includes a driving assembly 31 and a cushioning assembly 40. The driving assembly 31 includes trough 32, a box 33, a worm 34, a crank 35, an axle 36, a shaft 37, two pinions 38, and two tubs 39.

The trough 32 is connected to the corresponding side of the reclining mechanism 20 of the recliner 10. The box 33 is formed in or connected to a middle portion of the trough 32. Each of the cylinders 39 is connected to a corresponding one of two opposite ends of the trough 32.

The worm 34 includes a first section located in the box 33 and a second section located out of the box 33. The crank 35 is connected to the second section of the worm 34 so that the crank 35 is operable to rotate the worm 34.

The axle 36 is located in the box 33. The axle 36 extends perpendicular to the worm 34. A worm gear 361 is connected to a section of the axle 36. A toothed wheel 362 is connected to another section of the axle 36. The worm gear 361 is engaged with the worm 34 so that the axle 36 is rotatable by the worm 34.

The shaft 37 is located in the trough 32. The shaft 37 extends parallel to the axle 36. A toothed wheel 370 is connected to a middle section of the shaft 37. The toothed wheel 370 is engaged with the toothed wheel 362 so that the shaft 37 is rotatable by the axle 36.

Each of the pinions 38 is connected to a corresponding one of two opposite ends of the shaft 37. Each of the cylinders 39 includes an aperture 390 for receiving a portion of a corresponding one of the pinions 38.

The cushioning assembly 40 includes an supporting tube 41 and two racks 42. A cushion (not numbered) is supported on the supporting tube 41. Each of the racks 42 includes an upper end connected to a lower portion of the supporting tube 41. Each of the racks 42 includes a lower end movably located in a corresponding one of the cylinders 39.

Each of the racks 42 include a toothed portion 43 engaged with a corresponding one of the pinions 38 so that the racks 42 are movable by the shaft 37. Thus, the elevation of the supporting tube 41 of the cushioning assembly 40 is adjusted.

Figure 5:
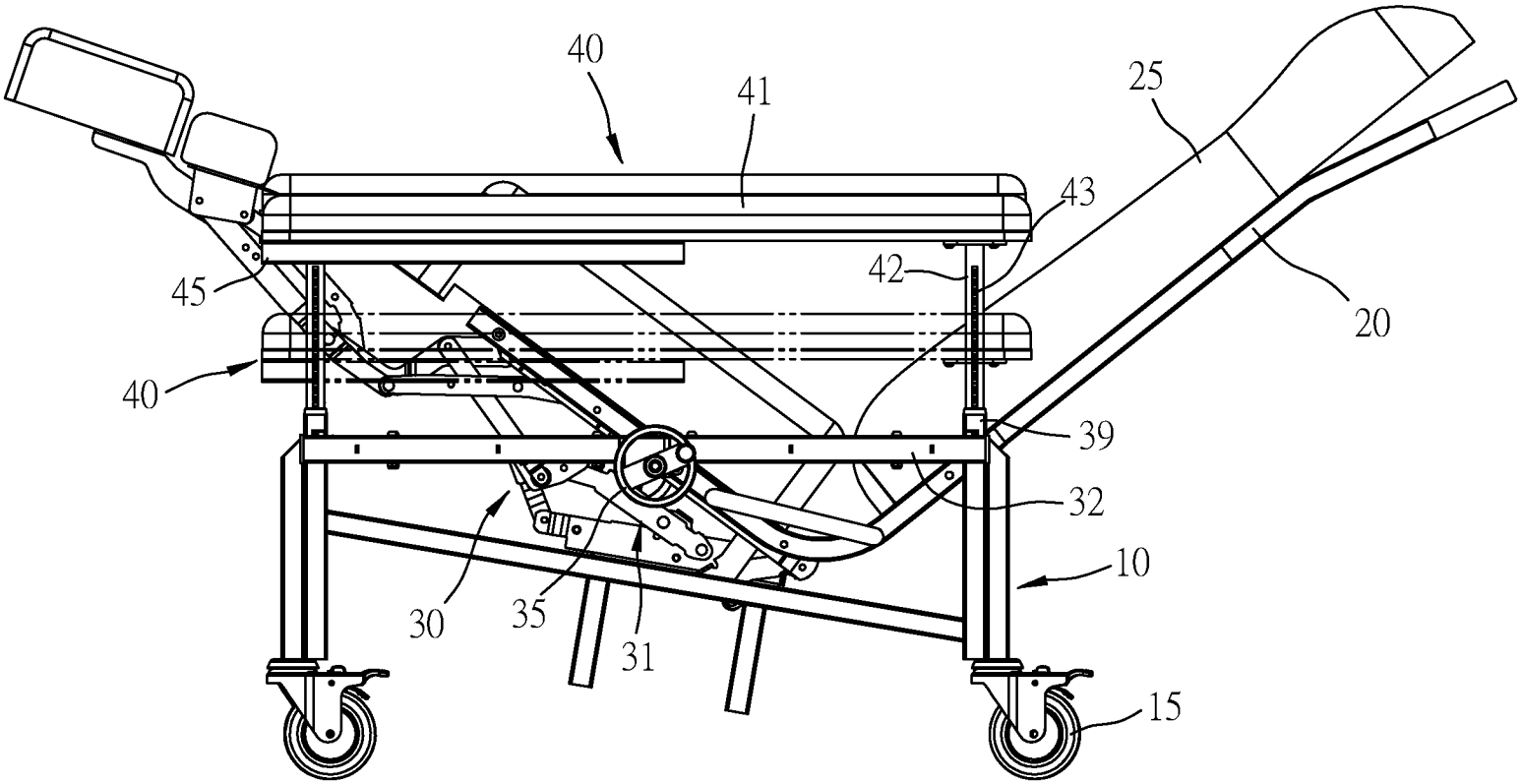
FIG. 5 is a side view of the nursing chair according to the preferred embodiment of the present invention.
Figure 6:
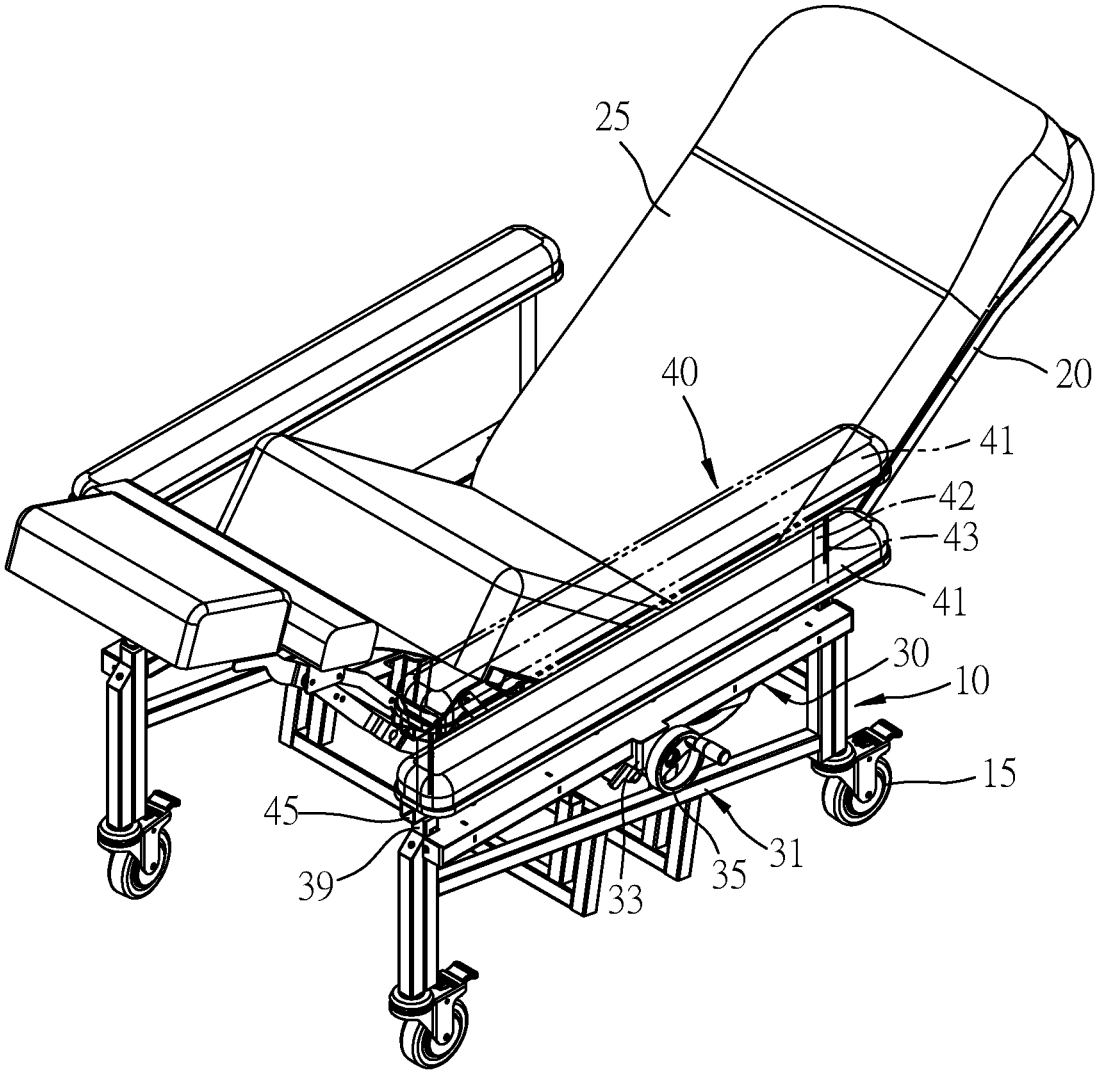
FIG. 6 is a perspective view of the nursing chair and the elevation-type armrests in another position than shown in FIG. 1.

Referring to FIGS. 1, 5 and 6, the elevation of each of the elevation-type armrests 30 is adjustable independent of the other elevation-type armrest 30. In each of the elevation-type armrests 30, the crank 35 of the driving assembly 31 of is operable to adjust the elevation of the supporting tube 41 of the cushioning assembly 40. In specific, the crank 35 rotates the worm 34. The worm 34 rotates the axle 36 because the worm 34 is engaged with the worm gear 361, which is connected to the axle 36. The axle 36 rotates the shaft 37 because the toothed wheel 362, which is connected to the axle 36, is engaged with the toothed wheel 370, which is connected to the shaft 37. The shaft 37 moves the racks 42 because the pinions 38, which are connected to the shaft 37, are engaged with the toothed portions 43 of the racks 42. Thus, the supporting tube 41 is moved because it is connected to the racks 42.

In use, it is preferred to lower the elevation-type armrests 30 before the user starts to sit down in or stand up from the recliner 10. The elevation-type armrests 30 are lifted after the user finally sits in or stands up from the recliner 10. Thus, the elevation-type armrests 30 property support and protect the user's arms.

Furthermore, the worm 34 is engaged with the worm gear 361 of the axle 36 in the box 33, thereby executing a self-locking operation. The supporting tube 41 is kept in position unless the crank 35 is operated on purpose. Thus, the user can press on the supporting tubes 41, without lowering the supporting tubes 41 by accident. That is, the user is well supported by the supporting tubes 41 while he or she is sitting down in or standing up from the recliner 10.

Figure 7:
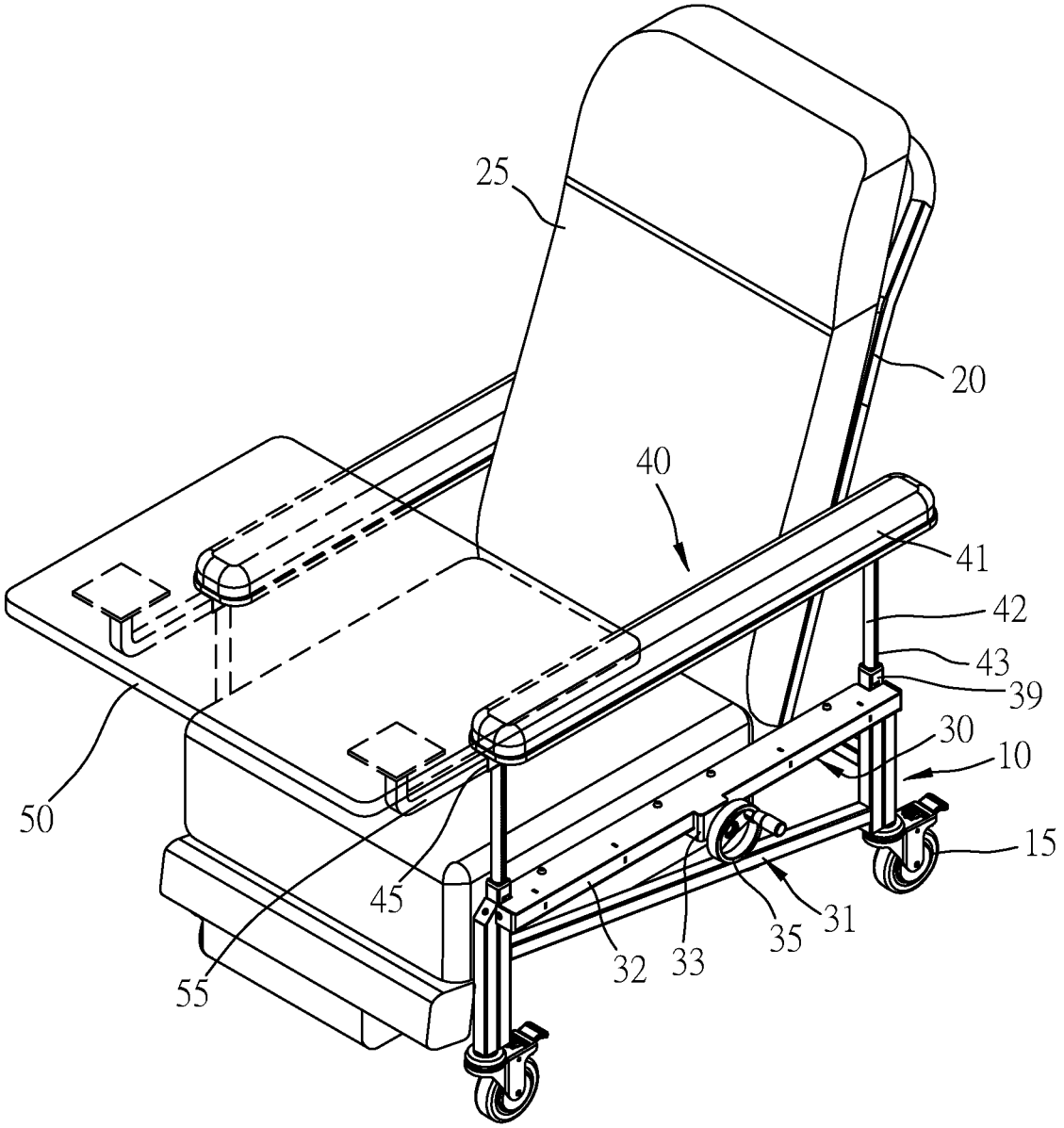
FIG. 7 is a perspective view of the nursing chair and the elevation-type armrests in another position than shown in FIG. 6.

Referring to FIG. 7, the recliner 10 further includes a table 50 and two rods 55. The cushioning assembly 40 of each of the elevation-type armrests 30 further includes a sleeve 45 connected to a lower portion of the supporting tube 41. Each of the rods 55 includes an end connected to a lower portion of the table 50 and another end movably located in the sleeves 45 of the cushioning assembly 40 of a corresponding one of the elevation-type armrests 30 so that the table 50 is connected to the elevation-type armrests 30. Thus, the user can put food and drinks on the table 50.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An elevation-type armrest comprising:

a driving assembly comprising:

a trough connected to a side of a chair;

a box formed in a middle section of the trough;

two cylinders connected to two opposite ends of the trough, wherein each of the cylinders comprises an aperture;

a worm comprising a first section located in the box and a second section located out of the box;

a crank connected to the second section of the worm;

an axle located in the box so that the axle extends perpendicular to the worm;

a worm gear connected to the axle and engaged with the worm;

a first toothed wheel connected to the axle;

a shaft located in the trough so that the shaft extends parallel to the axle;

a second toothed wheel connected to the shaft and engaged with the first toothed wheel; and two pinions connected to two ends of the shaft, wherein each of the pinions comprises a portion located in a corresponding one of the cylinders via the aperture; and a cushioning assembly comprising:

two racks, wherein each of the racks comprises a toothed portion movably located in a corresponding one of the cylinders and engaged with a corresponding one of the pinions; and a supporting tube connected to the racks.

2. A chair comprising two elevation-type armrests, wherein each of the elevation-type armrests comprises:

a driving assembly comprising:

a trough connected to a side of the chair;

a box formed in a middle section of the trough;

two cylinders connected to two opposite ends of the trough, wherein each of the cylinders comprises an aperture;

a worm comprising a first section located in the box and a second section located out of the box;

a crank connected to the second section of the worm;

an axle located in the box so that the axle extends perpendicular to the worm;

a worm gear connected to the axle and engaged with the worm;

a first toothed wheel connected to the axle;

a shaft located in the trough so that the shaft extends parallel to the axle;

a second toothed wheel connected to the shaft and engaged with the first toothed wheel; and two pinions connected to two ends of the shaft, wherein each of the pinions comprises a portion located in a corresponding one of the cylinders via the aperture; and a cushioning assembly comprising:

two racks, wherein each of the racks comprises a toothed portion movably located in a corresponding one of the cylinders and engaged with a corresponding one of the pinions; and a supporting tube connected to the racks.

3. The chair according to claim 2, wherein the chair is a nursing chair.

4. The chair according to claim 3, comprising wheels connected to a lower portion.

5. The chair according to claim 4, comprising a reclining mechanism connected to an upper portion.

6. The chair according to claim 5, comprising a multi-sectional cushion supported on the reclining mechanism.

7. The chair according to claim 2, comprising a table connected to the elevation-type armrests.

8. The chair according to claim 7, comprising two rods connected to the table, wherein each of the elevation-type armrests comprises a sleeve connected to the supporting tube, and each of the rods comprises a section located in the sleeve of a corresponding one of the elevation-type armrests.

* * * * *